United States Patent [19]

Rebsamen

[11] Patent Number: 5,010,724

[45] Date of Patent: Apr. 30, 1991

[54] METHOD AND APPARATUS FOR PRODUCING PACKAGES

[75] Inventor: Arthur Rebsamen, Stallikon, Switzerland

[73] Assignee: Machinenfabrik Schweiter AG

[21] Appl. No.: 285,191

[22] Filed: Dec. 16, 1988

[30] Foreign Application Priority Data

Dec. 16, 1987 [CH] Switzerland ..... 4899/87

[51] Int. Cl.[5] ..... D01H 9/10

[52] U.S. Cl. ..... 57/270; 57/281; 57/313; 242/35.5 A

[58] Field of Search ..... 57/75, 270, 271, 274, 57/275, 268, 281, 313; 242/35.5 R, 35.5 A

[56] References Cited

U.S. PATENT DOCUMENTS

| | | | |
|---|---|---|---|
| 3,391,527 | 0/0000 | Kato | 57/313 |
| 3,768,241 | 10/1973 | Nelson et al. | 57/268 X |
| 3,903,681 | 9/1975 | Bous | 57/313 |
| 4,233,810 | 11/1980 | Kamp | 57/271 X |
| 4,566,263 | 1/1986 | Miyazaki et al. | 57/281 X |
| 4,571,931 | 2/1986 | Küpper | 57/281 |
| 4,628,686 | 12/1986 | Tone et al. | 57/275 X |
| 4,838,019 | 6/1989 | Ueda | 57/281 X |

*Primary Examiner*—Joseph J. Hail, III

[57] ABSTRACT

Packages, particularly cross-wound packages are produced directly at a ring spinning frame. In a method and apparatus for making packages a rewinding device is provided for a group of spinning stations. The rewinding device comprises a fixed winding station and a gripping device movable along the group of spinning stations. The rewinding device is able to perform all the manipulations for starting up a spinning process with empty yarn carriers. It is also possible to change the full yarn carriers and mount the empty yarn carriers on a spinning frame, remove thread breaks and carry out spinning following a batch change. Spinning of the individual yarn carriers takes place individually, so that when replacing one yarn carrier, the other spinning stations continue to operate. This leads to a high production rate of the ring spinning frame and simultaneously reduces costs for rewinding compared with known systems.

2 Claims, 3 Drawing Sheets

Fig. 5
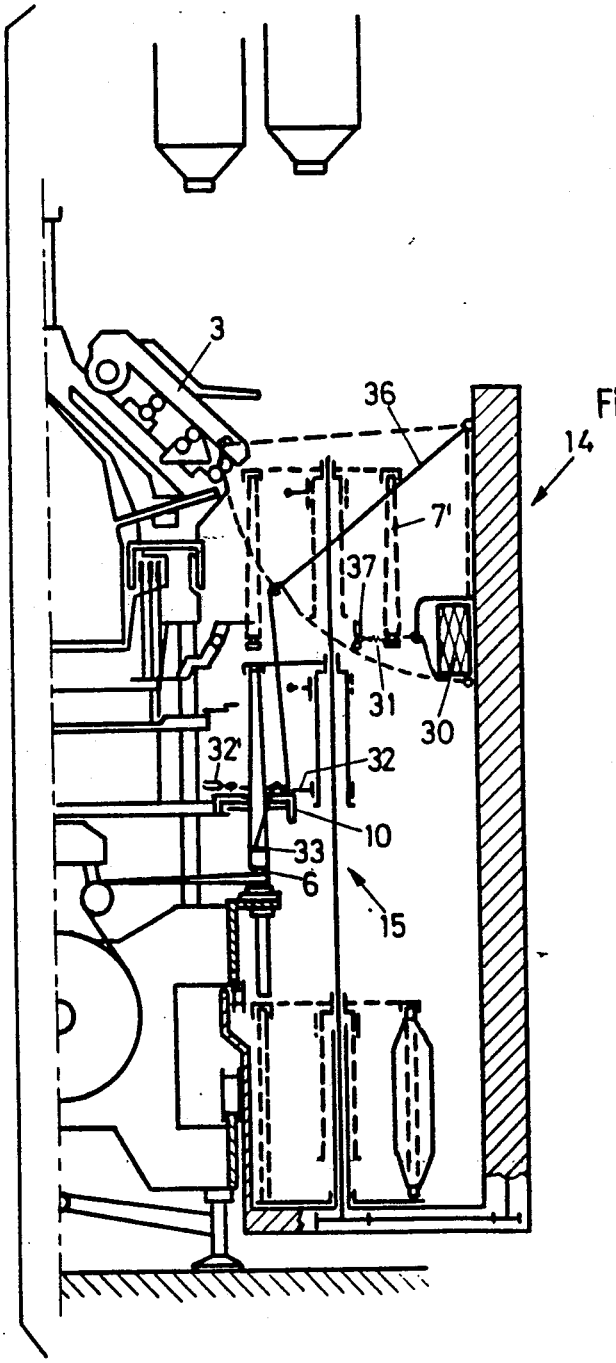
Fig. 6b
Fig. 6d
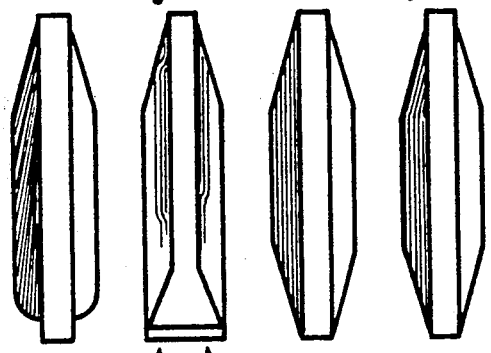
Fig. 6a
Fig. 6c
Fig. 7
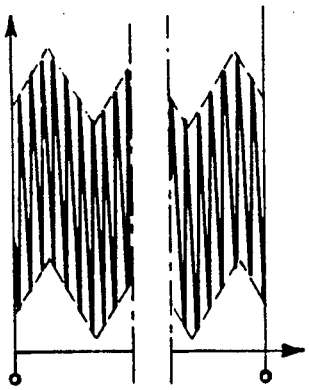
Fig. 8
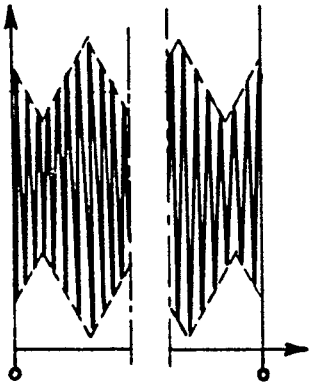

METHOD AND APPARATUS FOR PRODUCING PACKAGES

BACKGROUND OF THE INVENTION

The present invention relates to a method for producing a package, in which a yarn carrier spun in a ring spinning frame is rewound in a following rewinding machine to make packages and to an apparatus for performing this method.

The production of packages takes place by means of cone winding frames or machines, on which yarn carriers, called cops, are wound off and rewound to packages, whilst during winding off, a simultaneous check is made on the thread for defects and for removing the latter. The yarn carriers are produced in the spinning mill and transported to the rewinding machines. Ring spinning frames are almost exclusively used for producing the yarn carriers.

It is known to reduce the transportation path between the ring spinning frame and the rewinding machine in that said two means are juxtaposed as a so-called compound or composite system and are interlinked by a conveyor, e.g. a conveyor belt. The conveyor belt is used for conveying the full yarn carriers from the ring spinning frame to the cone winding frame. On the latter the yarn carriers are taken from a magazine, from which they are supplied to the individual winding positions.

Such a composite system already has a relatively high degree of automation. Following onto the ring spinning frame, spinning of the yarn carriers takes place, preparation occurs for the doffing thereof, after which spinning is stopped and the yarn carriers are raised from the spinning spindles and placed onto the conveyor belt. The gripping of the empty yarn carriers from the conveyor belt and the placing thereof on the spinning spindles and then the start of spinning also takes place on the ring spinning frame. Following the spinning of the yarn carriers, they are discharged on the conveyor belt to the cone winding frame and simultaneously the empty yarn carriers are placed onto the conveyor belt. This leads to automatic conveying of the full yarn carriers from the ring spinning frame to the cone winding machine and the automatic conveying of the empty tubes or carriers from the cone winding machine back to the spinning frame.

In the cone winding machine the yarn carriers are removed from the conveyor belt of the ring spinning frame and transferred to the conveyor system of the cone winding machine. In a preparatory station the thread is sought on the yarn carrier and held and then the yarn carrier is conveyed to the winding station, where the thread is gripped and connected to the package thread, after which the thread is unwound from the yarn carrier. This is followed by the inspection of the empty yarn carrier with respect to yarn residue and subsequently the conveying of the empty yarn carrier back to the conveyor belt of the ring spinning frame, where the empty yarn carrier is transferred to the conveyor belt.

In connection with ring spinning machines use is also made of attachment means, which can fulfil several functions. The attachment means travel along the spinning frame. When a thread break is noted, the attachment means is stopped, the spindle is stopped and raised from the spinning frame. This is followed by the search for the thread end on the yarn carrier, then the latter is again placed on the spinning spindle, the ring traveler is threaded and the thread is attached on the supply cylinder of the drawing frame, after which the attachment means again starts its displacement.

Despite this relatively high degree of automation in the known compound system, on the ring spinning frame, the starting spinning in the case of a batch change, the thread break removal during doffing and the removal of rolls, as well as on the winding machine the removal of faults occurring thereon and the processing of ejected yarn carriers must be carried out manually by the spinner or winder.

Finally, in the case of the compound system it is also possible to use cleaning means on the ring spinning frame, as well as production data acquisition means. Despite the fact that the known compound system constitutes an advance compared with the separate arrangement of the ring spinning frame and cone winding machine, a large number of manipulations are still required thereon.

SUMMARY OF THE INVENTION

Accordingly, it is an object of the present invention to develop a method of the aforementioned type for making packages such that the yarn can be rewound from the ring spinning spindle with less manipulations onto the package and wherein the degree of utilization of the ring spinning frame is increased and due to the possibility of using different rovings, it will be possible to increase the flexibility of the ring spinning frame.

According to the invention this and other objects of the invention are attained in that the rewinding of the yarn carrier to packages takes place on the ring spinning frame.

The present invention also covers an apparatus, whose function is to permit an optimum performance of the method.

According to the invention objects of the invention are attained by an apparatus, in which for each group of spinning stations on the ring spinning frame there is provided a rewinding device, which carries a winding station for rewinding the yarn carrier spun on the spinning stations to packages and comprising gripping means for removing and supplying the yarn carrier from and to a spinning station and for conveying the yarn carrier from and to the winding station.

The invention is described in greater detail hereinafter relative to non-limitative embodiments and the attached drawings.

BRIEF DESCRIPTION OF THE DRAWINGS

FIG. 5 is a partially sectional elevation view similar to that of FIG. 2 for the illustration of the starting spinning process;

FIGS. 6*a* to 6*d* illustrate different winding types on yarn carriers for ring spinning frames; and FIGS. 6 and 7 show diagrams of the ring rail movement as a function of time.

In the drawings, similar elements are designed at like reference numerals.

DETAILED DESCRIPTION OF THE PREFERRED EMBODIMENTS

The present invention is based on the idea that a reduction of the expenditure for producing a package by unwinding the yarn carrier spun in the ring spinning machine can be achieved, if the winding off of the yarn carrier arriving from the ring spinning frame takes place directly on the latter or at the particular spinning station. It is important that no constructional changes have to be made on the ring spinning frame. Only the operation differs, in that it is no longer necessary to remove simultaneously the full yarn carriers from the spinning stations and to simultaneously engage empty yarn carriers and instead each spinning station spins the yarn carrier until it is full, whereby it is then removed and an empty tube is engaged. Thus, the yarn carriers become full in a random sequence and, after establishing the end of the spinning process, they are successively removed from the spinning station and replaced by an empty tube. The rewinding of the full yarn carriers to packages also takes place successively in the same way. For carrying out all the manipulations on the ring spinning frame use is made of a rewinding device, which is arranged on the longitudinal side of the ring spinning frame. It is important that a rewinding device has a fixed association with one group of spinning stations, which means that there is no need for a conveyor belt, such as is used in the known compound systems. It is appropriate for the areas of the individual groups to overlap.

Figure 1:
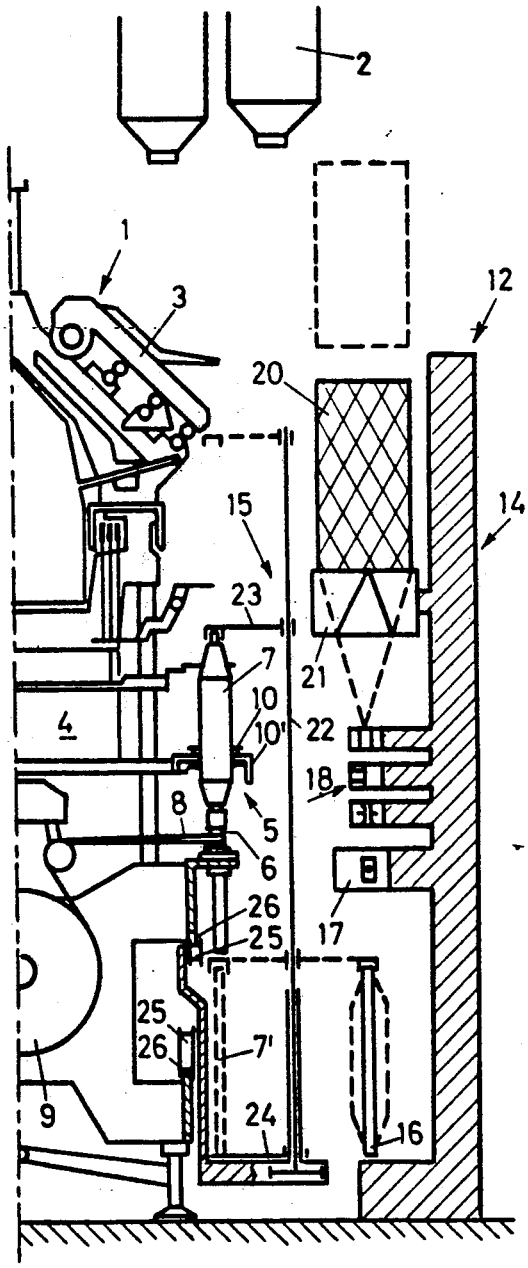
FIG. 1 is a partially sectional elevation view of a ring spinning frame with a rewinding device, the winding station of which is fixed and the gripping device of which is movable.

A rewinding device 12 shown in FIG. 1 is arranged on the longitudinal side of a ring spinning frame 1. The latter can be a random, known model, whereof only those parts are diagrammatically shown, which have a link with the present invention. The construction of the ring spinning frame 1 is assumed as known. A drawing frame 3 for each spinning station is provided on a machine column 4 below a not shown creel with rovings 2. Each spinning station 5 includes a rotating spindle 6, on which is placed a yarn carrier 7 in the form of a tube. Spindle 6 of spinning station 5 is driven via a belt drive 8 by a common driving shaft 9 or by a single spindle drive. The thread running up onto the yarn carrier 7 is threaded into a rotating ring traveller which, as a result of its rotation, brings about the winding of the spun yarn.

The left-hand side of the drawing is homologously constructed, so that it has been omitted. In the known compound system handling means are arranged on either side of the ring spinning frame, which are used for removing the full yarn carriers and for inserting empty tubes.

Figure 3:
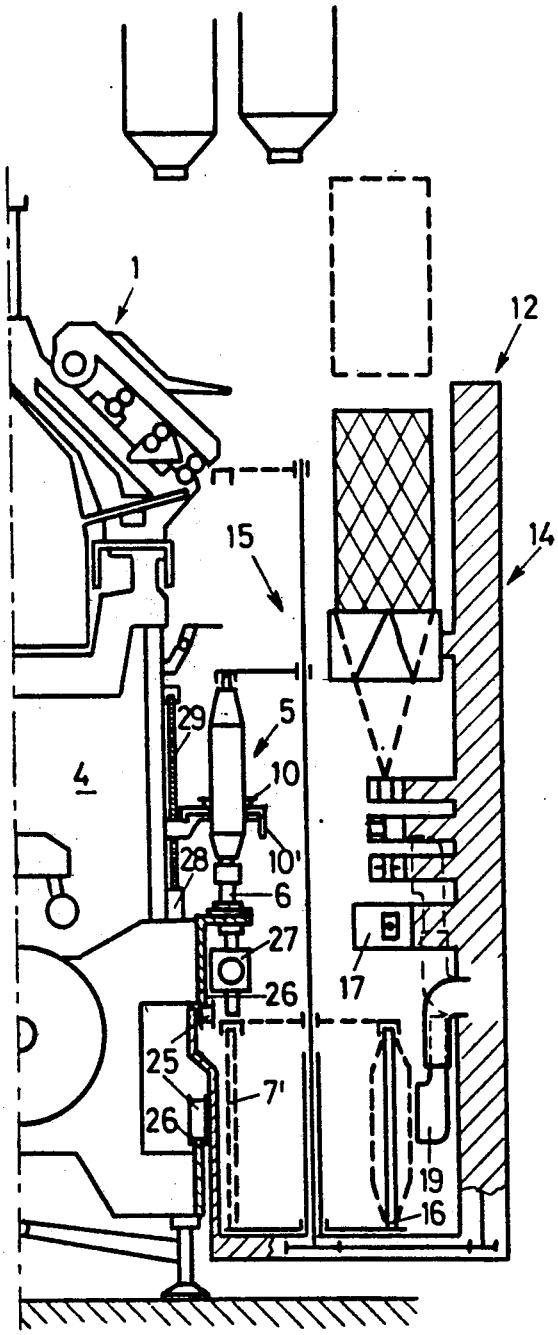
FIG. 3 is a partially sectional elevation view similar to that of FIG. 2 with a movable rewinding device and in which individual drives are provided for each spindle and for the ring movement.

FIG. 1 shows the rewinding device 12, such as is necessary for performing the inventive method. Rewinding device 12 essentially comprises a winding station 14 and a gripping device 15. Rewinding device 12 is used for a group of spinning stations 5. The rewinding device 12 is allocated to each group. The winding station 14 has a holder 16 for receiving full yarn carrier 7. Holder 16 is arranged at the base of the winding station 14. At this point, as seen in FIG. 3, due to the rotation of the yarn carrier, a yarn carrier nozzle 19 seeks and grasps the end of the yarn to be wound off, supplies it to a yarn joining device 17 and connects it to the yarn of the package. Yarn carrier nozzle 19 can be pivoted into the position shown by broken line. The yarn joining device 17 can be a yarn knotter or yarn splicer of any suitable conventional design.

Above the yarn joining device 17 are arranged control or inspection devices 18 for inspecting the yarn during its passage for defects. Above the control or inspection devices 18, is arranged a cross-wound package 20 driven by a rotary driving roller 21 arranged on the circumference thereof, whereby the yarn to be wound on is passed through a grooved drum of cross-wound package 20 and is placed thereon. The grooved drum can be replaced by any different yarn laying system.

Joining device 17, control or inspection devices 18 and yarn carrier nozzle 19 are of any suitable conventional type and a detailed description thereof appears to be unnecessary.

The function of the gripping device 15 of rewinding device 12 is to perform all the necessary manipulations to maintain the spinning process with empty yarn carriers 7'. The gripping device 15 has a column 22 on which a gripper arm 23 is rotatable and movable up and down. The gripper arm 23 grips the full yarn carrier 7, removes it from the spinning station 5, swings it to the side and sets it down in a waiting station. The latter can be located on a rotary table 24, where there can be further stations for receiving empty and full yarn carriers. The gripper arm 23 now grips an empty yarn carrier 7' positioned on rotary table 24, raises it and engages it on the spindle 6 of spinning station 5. The gripper arm 23 can then bring the full yarn carrier 7 placed on rotary table 24 into the holder 16 of winding station 14, where the thread is wound off and removed to cross-wound package 20. It is also possible to use two gripper arms, one of which is used for changing the yarn carrier 7 on the ring spinning frame 1 and the other for the interchange to and from the winding off station. If a thread break occurs, the only partly spun yarn carrier 7 is removed by the gripper arm 23 from the spinning station 5 in the same way as a full yarn carrier is brought into the waiting station on rotary table 24, where the partly full yarn carrier 7 is wound off in the same way as a full yarn carrier.

Thus, changing a yarn carrier 7 at spinning station 5 comprises the detection of the end of the spinning process, stopping the spindle and removing the yarn carrier 7 by gripper arm 23.

There can be two different constructions of the rewinding device 12. Either both the winding station 14 and the gripping device 15 are movable, cf. FIG. 2, or the winding station 14 is fixed and the gripping device 15 moves along the group of spinning stations 5 associated therewith, cf. FIG. 1. In both cases the gripping device 15 moves along, optionally together with the winding station 14, within the range of the associated spinning stations 5 of the group, transfers the yarn carrier 7 from spinning spindle 6 directly into the winding off position of winding station 14, or into a waiting position upstream of the winding-off position, e.g. on rotary table 24.

The conveying of the full, partly full and empty yarn carriers 7 now takes place within the rewinding device 12. The replacement of the full yarn carriers 7 at the spinning stations 5 can take place at any time, because the full yarn carrier is produced individually. Nevertheless it is possible to have a time check for each spinning station 5 for establishing the operating time. In the same way rewinding can take place during the displacement of the gripping device 15 or the complete winding device 12, or when the winding station 14 is stationary. The individual spinning of the individual yarn carriers 7 at the spinning stations 5 makes it possible for spinning to be continued at the other spinning stations 5 when changing a full yarn carrier.

Figure 2:
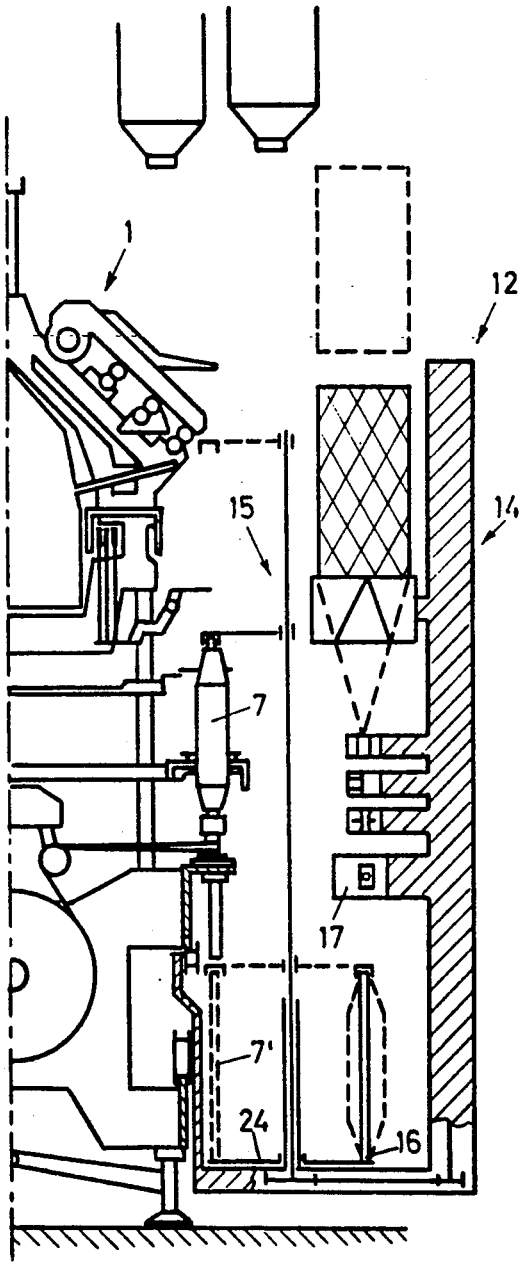
FIG. 2 is a sectional view similar to that of FIG. 1, but with a movable rewinding device.

FIGS. 2 and 3 show the rewinding device 12, in which both the winding station 14 and the gripping device 15 are movable. The rewinding device 12 is constructed as a carriage or trolley, provided with rollers 25, which run on rails 26, which are fixed to the machine column 4 for the ring spinning frame 1.

In FIG. 3 the ring spinning frame 1 is equipped with individual drives for spindles 6. Each spinning station 5 is equipped with a motor drive 27. The ring carrier 10, with the traveller 10 for each spinning station 5 is also moved up and down via a spindle drive 29 by an individual motor drive 28.

Figure 4:
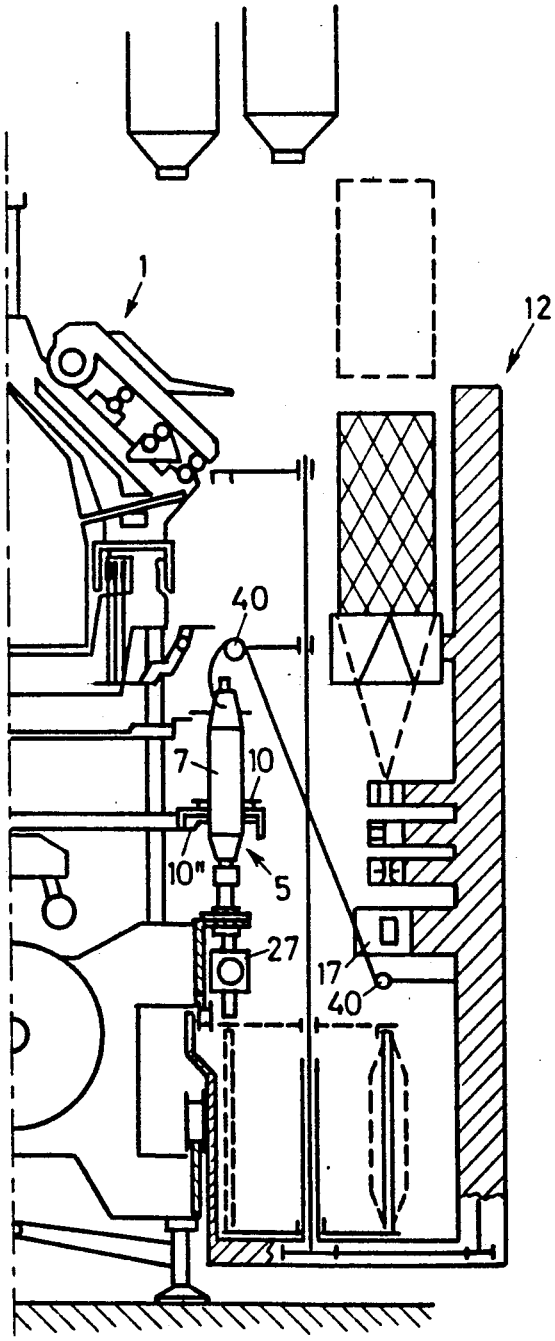
FIG. 4 is a partially sectional elevation view similar to that of FIG. 2 on which rewinding of the yarn carrier takes place directly from the spinning station.

FIG. 4 shows the ring spinning frame 1 with the rewinding device 12 which is movable. The spindles 6 are driven by individual motor drives 27, whilst the ring rail 10'' with the ring traveller 10 is moved up and down by the main drive of ring spinning frame 1. It is also possible to use an individual ring carrier drive.

The difference of the construction of FIG. 4 as compared with FIG. 3 is that the winding off of the yarn carrier 7 takes place in the spinning station 5. Yarn guidance and feeding shown in simplified diagrammatic form is performed by using a guide pulley 40. Here again the yarn end is caught by the thread seeking nozzle and transferred to the thread joining device 17.

The arrangement shown in FIG. 4 will probably only be used in special cases, because during the winding off of the yarn carrier 7 the spinning station 5 cannot be put into operation. However, it is advantageous that the motor drive 27 can be used for speeding up the running off of the yarn.

Independently on whether a full or a partly full yarn carrier 7 is removed from the spinning station 5, this is followed by the initial spinning of the thread by applying the yarn carrier 7, as shown in FIG. 5.

As seen from FIG. 5, a starter yarn 31 is removed from a reserve or store bobbin 30 and placed on an empty yarn carrier 7', e.g. by clamping or winding. In this case the empty yarn carrier 7' has a yarn clamp 33. The starter yarn 31 is threaded on ring traveller 10' by a traveller threader 32 and an air nozzle 32'. A yarn laying or application arm 36 is then swung out and the starter yarn 31 is taken along with it. Then a cutter 37 cuts the starter yarn 31 and the latter is raised to a run-out cylinder of the drawing frame 3, where initial spinning takes place. The reserve spool or bobbin 30 is appropriately located on the movable winding device 14. If the rewinding device 14 is fixed, then the reserve bobbin 30 is to be constructed to be movable with the gripping device 15.

The individual spinning at each spinning station 5 with the known ring rails, cf. FIG. 6 results in that in place of the conventional cop winding, it is possible to use a winding referred to as random winding, cf. FIGS. 6*a* and (*b*). For reasons of completeness a parallel winding (FIG. 6*c*) and a combination winding (FIG. 6*d*) are also shown. There are two variants of the random winding (FIG. 6*b*), which only differ in the movement of the ring rail. The movement sequence over the time is shown in the two diagrams illustrated in FIGS. 7 and 8, respectively showing variants 1 and 2. Spinning can start and be broken off at a random point. The ring rail periodically always performs the same lifting movement.

By fitting the rewinding device 12 on the ring spinning frame 1 package production is greatly simplified. The gripping device 15 can also be used for the independent starting of the spinning spindles 6 during a batch change, i.e. on changing the roving or changing the machine setting.

Due to the fact that each spinning station 5 is individually changed, whilst the other spinning stations 5 continue to run, the production capacity is increased. The rewinding device 12 is required for each group of spinning stations 5. Spinning on the ring spinning frame 1 can take place without production loss, if the number of yarn carriers 7 for each group is greater by one or more yarn carriers than the number of spinning stations in a group.

If the spinning station 5 is provided with an individual ring carrier movement, in the case of a full yarn carrier there can be a backwinding and an underwinding, as in the known doffing process, so that with the rewinding device 12, the known yarn carrier change (doffing process) and spinning start can take place without initial spinning. If the automatic initial spinning and automatic thread break removal are not required, these processes can also be performed manually and the automatic initial spinning device shown in FIG. 5 can be obviated.

If, as is now conventional with cop winding, the yarn carriers of a group are to be simultaneously completely spun, they are successively replaced by empty yarn carriers. The full yarn carriers are kept ready for rewinding in an intermediate store or reservoir, e.g. in a rotary table.

The yarn carrier nozzle can also be used to remove yarn residues from the yarn carrier after winding off and for this purpose the yarn carrier must be rotated. This can take place in the rewinding station or in an adjacent station.

During the winding of yarn, a different starter yarn must be separated from the yarn being wound. This takes place on detecting the starter yarn in the thread cleaner and subsequent cutting of this yarn. The yarn residue remaining on the yarn carrier is sucked off, in the manner described hereinbefore. It is always necessary to bring the completely empty yarn carrier to the initial spinning means.

The device means 12 can also fulfill additional functions, e.g. roving stop, blowing off and cleaning the ring spinning frame, monitoring the ring spinning frame by means of sensors and changing the ring traveller 10.

The finished packages 20 are appropriately placed on a conveyor belt and conveyed away at the end of the ring spinning frame.

There has been disclosed heretofore the best embodiment of the invention presently contemplated. However, it is to be understood that various changes and modifications may be made thereto without departing from the spirit of the invention.

What is claimed is:

1. Method for producing packages, comprising the steps of:

providing a plurality of yarn carriers, providing a ring spinning frame and a group of spinning stations, spinning the yarn carriers in the spinning stations, providing a rewinding station cooperating with said group of spinning stations, said rewinding station including a holder for receiving a yarn carrier, providing gripping means for handling a yarn carrier, taking up the yarn carrier by said gripping means in case of a thread break, a batch change and a full yarn carrier and conveying the yarn carrier to the holder forming part of the rewinding station, and rewinding the yarn carrier in the rewinding station to produce packages, wherein the gripping means is moved with the rewinding station along the spinning stations.

2. Apparatus for producing packages comprising:

a plurality of yarn carriers, a ring spinning frame and a group of spinning stations, spinning means for spinning yarn carriers provided in the spinning stations, a rewinding station cooperating with said group of spinning stations, said rewinding station including a holder for receiving a yarn carrier, gripping means for handling a yarn carrier, said gripping means being adapted in case of a thread break, a batch change and a full yarn carrier to take up the yarn carrier and to convey it to the holder forming part of the rewinding station, said yarn carrier being rewound in the rewinding station to produce packages, and means to move said rewinding station and said gripping means, together along the spinning stations.

* * * * *